US005192874A

United States Patent [19]

Adams

[11] Patent Number: 5,192,874

[45] Date of Patent: Mar. 9, 1993

[54] INTERFACE CIRCUIT FOR LOW POWER DRAIN MICROPROCESSOR-BASED THERMOSTAT

[75] Inventor: John T. Adams, Minneapolis, Minn.

[73] Assignee: Honeywell, Inc.

[21] Appl. No.: 765,855

[22] Filed: Sep. 26, 1991

[51] Int. Cl.[5] ..... H01H 47/00

[52] U.S. Cl. ..... 307/125; 307/126; 307/140

[58] Field of Search ..... 307/112, 113, 116-117, 307/119, 125, 126-130, 131, 139, 140-143; 431/16

[56] References Cited

U.S. PATENT DOCUMENTS 4,213,061 7/1980 Conner ..... 307/116
4,369,377 1/1983 Dytch ..... 307/117
4,832,594 5/1989 Youtz ..... 431/16
4,842,510 6/1989 Grunden et al. ..... 431/19
4,865,538 9/1989 Scheele et al. ..... 431/18
4,872,828 10/1989 Merzwinski et al. ..... 431/16
4,955,806 9/1990 Grunden et al. ..... 431/24

*Primary Examiner*—Jeffrey A. Gaffin
*Attorney, Agent, or Firm*—Edward Schwarz

[57] ABSTRACT

A microprocessor-based power switching circuit responds to a common form of noise by disconnecting power from the controlled apparatus. The microprocessor provides an alternating voltage when power is to be provided, and the alternating voltage is converted by a detector circuit to a voltage close to ground which cuts off a transistor. When the transistor is cut off, an interface circuit places a thyristor which performs the actual power switching, into conduction. Noise on the base of the transistor can only drive it into conduction which then puts the thyristor into non-conduction.

7 Claims, 1 Drawing Sheet

INTERFACE CIRCUIT FOR LOW POWER DRAIN MICROPROCESSOR-BASED THERMOSTAT

BACKGROUND OF THE INVENTION

The microprocessor-based thermostats which have become very prevalent provide substantial advantages of safe and accurate control of furnaces and air conditioning. In addition, the use of microprocessors allows easy addition of various features not otherwise easy to provide and at the same time improves the ease with which the owner can select the thermostat actions and parameters desired.

In these types of thermostats there are two main systems for providing power to the thermostat electronics. In one type, power is "stolen" when the relay or thyristor which controls furnace operation is open, from the 24 VAC power transformer which operates the furnace components. This power drives a DC power supply which charges a battery. The battery then operates the thermostat components. A second design uses simple replaceable dry cells as the power source for the microprocessor. Because the market demands it, it is necessary to extract a full season's use out of one set of dry cells. Therefore, the microprocessor itself as well as any other circuitry powered by the replaceable dry cells must have very low power draw.

Because of this requirement for low power draw, it is necessary for the microprocessor to provide very low power output signals to switch the power to the HVAC control. However, the use of low power output signals makes them vulnerable to noise which may cause power to be briefly supplied to the HVAC control. At the very least, such noise pulses can provide short power spikes which actuate the internal HVAC control relays briefly, and in a noisy situation, can lead to shortened control life. Certain types of controls also have timed sequences which start upon first application of power, and in this case each noise pulse will cause at least the first part of the sequence to occur. This is obviously undesirable.

In these controls it is also desirable to use an inexpensive thyristor such as a triac as the switching element to control the power to the HVAC control rather than the relatively expensive latching relay which has been used in the past. The term "thyristor" is used hereafter to refer to any semiconductor device used for switching AC power. Power to operate the thyristor control circuitry is taken from across the thyristor. It is possible for this thyristor control circuitry to sometimes take a state which makes the thyristor conducting when power is first applied to them. It is important that failures in thermostat operation always lead to removing power from the HVAC control. This is because particularly in the operation of a furnace, continuous operation of the controlled device is much more dangerous than simply shutting it down. So in situations where a short power failure occurs, upon power being restored, the thyristor must not assume its conducting state.

A further safety-related problem involves complete or partial operating failure of the microprocessor. It is not easy to detect such a condition, but use of a watchdog-type of output port to produce the signal calling for conduction by the thyristor can substantially reduce the likelihood of microprocessor failure locking the thyristor in a conducting condition. Such a microprocessor port calls for conduction by the thyristor with a square wave output signal oscillating at some predetermined frequency generated by or during the execution of the programmed instructions. Any signal having a constant voltage or a frequency different from the predetermined value is used to request that the thyristor not conduct. An example of such a watchdog signal pattern in the burner control field is shown in U.S. Pat. No. 4,865,538. The theory is that it is unlikely that an improperly operating microprocessor will usually be incapable of producing the predetermined frequency as the output signal, and in fact this is a reasonable expectation.

U.S. Pat. No. 5,151,854 issued Sep. 29, 1992; having as joint applicant the applicant in this application, having the same assignee, and entitled Integrated Low Voltage Detect and Watchdog Circuit, discloses a circuit of which part is very similar to the detector circuit portion of the circuit to be described.

BRIEF DESCRIPTION OF THE INVENTION

A microprocessor-controlled power switching circuit for controlling flow of electrical power to a system includes a thyristor having power terminals and a control terminal. The thyristor conducts between the power terminals responsive to a first state of a first control signal and blocks conduction between them responsive to a second state of the first control signal. The microprocessor for this circuit has an output port providing a power-on signal having an alternating voltage pattern in response to an external condition signal and a power-off signal comprising a steady state voltage otherwise.

The power switching circuit includes detector and interface circuits, the detector circuit receiving the power-on and power-off signals and comprising converter means for converting the power-on and power-off signals to a second control signal having respectively a constant first voltage near ground and a constant second voltage displaced from ground, and a first transistor having a base terminal and power terminals and receiving the second control signal at its base terminal and entering first and second conduction states responsive respectively to the first and second voltages of the second control signal.

The interface circuit includes a rectifier circuit having input terminals connected across the thyristor power terminals and an output terminal providing DC power when the thyristor is nonconductive, and a second transistor having a control terminal connected to the first transistor and allowing current flow comprising the first and second states of the first control signal from the rectifier circuit output terminal to the thyristor control terminal responsive respectively to the first and second conduction states of the first transistor.

The reader can see from this description that the thyristor conducts between its power terminals when the voltage to the first transistor is close to the ground voltage and does not conduct when the voltage is displaced from the ground voltage. At the same time, the system is protected against failures of the microprocessor by the use of the alternating voltage signal as calling for conduction by the thyristor. When the microprocessor fails, it will usually fail with its output terminal voltage at a constant value near ground. It is dangerous to use this value as calling for conduction by the thyristor because this is the normal failure mode for the microprocessor. And if the voltage displaced from ground is used as the call for conduction, the system is vulnerable to noise which may cause the ground voltage condition of the output terminal to momentarily change to the voltage displaced from ground.

BRIEF DESCRIPTION OF THE DRAWING

The FIGURE shows a preferred embodiment of the invention's circuit.

DESCRIPTION OF THE PREFERRED EMBODIMENT

Figure 1:
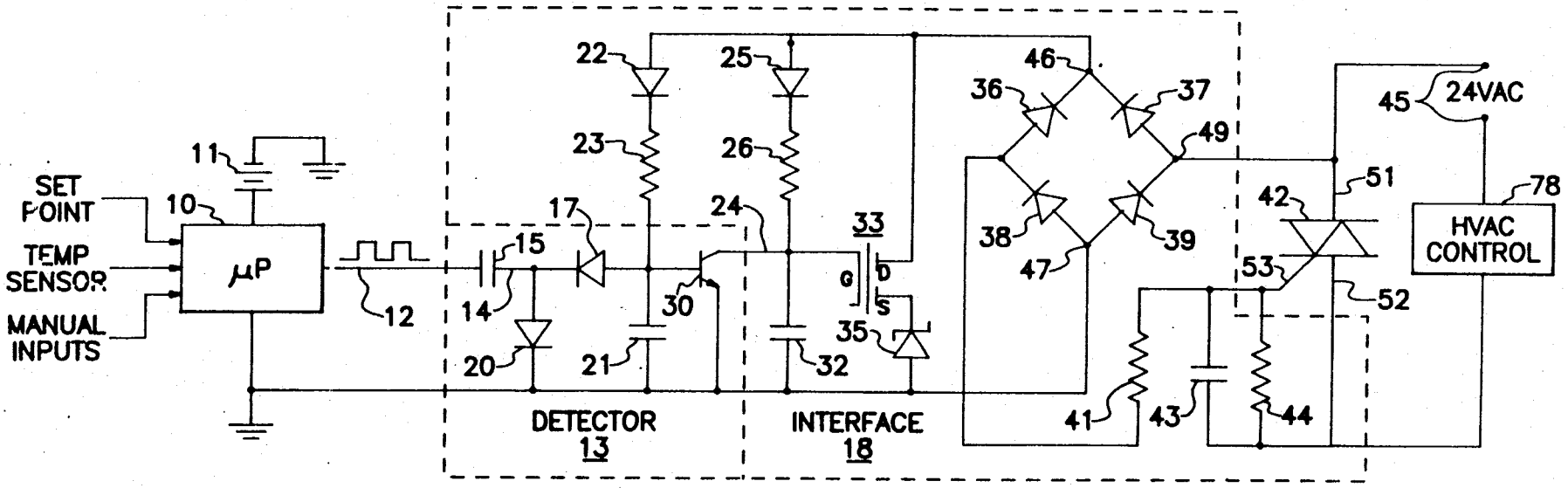

The circuit shown in the FIGURE is configured for use as a thermostat. A microprocessor 10 provides the various control functions for determining when heating or cooling is to be provided to the controlled space depending on externally supplied temperature sensor and temperature set point signals, as well as manual inputs which may involve setback functions, clock setting, and display selection. The microprocessor is powered by dry cells 11 which have a limited ability to provide operating power. The use of dry cells is one way to protect the relatively sensitive microprocessor from voltage spikes in the power which have the potential to either damage the circuitry or interrupt normal operation and require resetting and reprogramming. On type of microprocessor suitable for use in this invention is available from the Seiko Epson Corporation, Tokyo, Japan with the part No. SMC621A.

The microprocessor output of interest here is on signal path 12. The square wave shown adjoining it preferably has a 32.8 kHz. rate and represents an alternating voltage forming a power-on signal provided by microprocessor 10 when the thermostat "contacts" should be closed. In the Seiko Epson microprocessor preferred here, the power-on signal is generated internally by circuitry which can by execution of the proper command be caused to provide the 32.8 kHz. alternating voltage on signal path 12. The internal circuitry of this microprocessor is such that generation of this signal is a reliable indication of overall proper operation of the microprocessor. The power-on signal can also be generated by software if even greater reliability is thought desirable.

It is easiest to understand operation of this power switching circuit by next discussing the rectifier circuit portion of the power switching circuit's interface circuit section 18. A conventional diode bridge comprising diodes 36–39 connected across power terminals of a triac 42. Triac 42 switches 24 VAC power supplied at terminals 45 and which is used to power a conventional HVAC control 48. The rectifier circuit also includes resistors 41 and 44 and capacitor 43. When circuit points 46 and 47 are connected to each other the start of each positive half cycle of the AC power at circuit point 49 allows current flow through diodes 37 and 38 and resistor 41 into gate element 53 of triac 42. Positive current into gate element 53 causes triac 42 to conduct between its power terminals 51 and 52 until the end of the half cycle. During negative half cycles at terminal 51, current flows from gate element 53 through resistors 44 and 41 and diodes 36 and 39, allowing conduction on the negative halves of the AC cycles as well. Capacitor 43 provides a low impedance path for high frequency transients to bypass the triac gate element 53 without improperly firing triac 42.

A detector circuit 13 receives the power-on and power-off signals on path 12. When the steady-state voltage of the power-off signal on path 12 is present, transistor 30 is caused to conduct. When the 32.8 kHz. alternating voltage of the power-on signal on path 12 is present, then transistor 30 cuts off. This happens as follows: When the power-off signal is present on path 12, this constant voltage prevents capacitor 15 from affecting the operation of the remainder of the detector circuit 13. With capacitor 15 not affecting the operation of the detector circuit 15, a first charging circuit comprising diode 22 and resistor 23 can charge capacitor 21 with current stolen from the diode bridge and across the non-conducting triac 42 to a level which puts transistor 30 into conduction. On the other hand, when the 32.8 kHz. power-on signal is present on path 12, capacitor 15 is charged through diode 20 on the more positive half cycles. When the voltage on path 12 swings to ground, path 14 is then driven to below ground, because capacitor 15 is much larger (preferably 0.1 μfd.) than is capacitor 21 which is preferably 0.01 μfd. With capacitor 21 discharged to below ground, transistor 30 is cut off as stated. The charging circuit of diode 22 and resistor 23 cannot charge capacitor 21 quickly enough to ever place it in conduction when a 32.8 kHz. alternating voltage is present on path 12.

Transistor 3 controls conduction by FET (field effect transistor) 33. FET 33 is of a type such as the 2N7000 which conducts from drain (D) to source (S) when the gate (G) terminal is at least 2.2 v. above the voltage at the source terminal. The drain and source of FET 33 are respectively connected to the circuit points 46 and 47 (source through Zener diode 35) so as to close-the connection between these points when the gate voltage is more than 2.2 v. above the source voltage. If transistor 30 is not conducting, a second charging circuit comprising diode 25 and resistor 26 can charge capacitor 32 to approximately 6 v. again by stealing power from the diode bridge before the triac 42 breaks into conduction. Zener diode 35, which is selected to have a reverse voltage of around 3 v. is interposed between the source terminal of FET 33 and ground, so that capacitor 32 must have at least 5.2 v. across it for FET 33 to conduct. Resistors 23 and 26 both have values in the range of 100 to 200 kΩ.

When FET 33 conducts, then circuit points 46 and 47 are connected so that triac 42 conducts on each half cycle as explained above. But FET 33 conducts only when transistor 30 is not conducting. And transistor 30 does not conduct when the power-on signal is present on path 12. Accordingly, triac 42 conducts only in response to the power-on signal from microprocessor 10. Since the signal on the base of transistor 30 is close to ground when triac 42 is intended to conduct, the reader can see that noise occurring on the conductor attached to the base of transistor 30 can only cause transistor 30 to conduct and triac 42 to cease conduction. Therefore the only effect which noise can have is to turn off the triac 42. In this way, the circuit is immunized against improper triac 42 conduction arising from noise on the relatively low power portions of the circuit.

In addition, the value of capacitor 32 is preferably substantially larger than that of capacitor 21, and in my preferred embodiment, capacitor 32 is 0. μfd. and capacitor 21, as mentioned above, is 0.01 μfd. Resistors 23 and 26 are chosen to be similar in size giving the combination of resistor 23 and capacitor 21 a time constant approximately ten times that of the time constant of resistor 26 and capacitor 32. These relative component values and time constants resulting cause capacitor 21 to charge much more rapidly than does capacitor 32 when power is first applied at terminals 45. Therefore, transistor 30 always begins conducting when power is first applied (unless the power-on signal is present on path 12) before transistor 33 begins to conduct, keeping both transistor 33 and triac 42 in nonconduction when power is first applied. If these relative component sizes were not chosen, it is possible for triac 42 to conduct when power is first applied to the power switching circuit and then lock on in the conducting state. This is undesirable, as explained above.

The preceding describes my invention. What I wish to protect by letters patent is:

I claim:

1. A microprocessor-controlled power switching circuit for controlling flow of electrical power to a system including a thyristor having a control terminal and conducting between power terminals responsive to a first state of a first control signal and not conducting responsive to a second state of the first control signal, a microprocessor having an output port providing a power-on signal having an alternating voltage pattern in response to an external condition signal and a power-off signal comprising a steady state voltage otherwise, said switching circuit including a) a detector circuit receiving the power-on and power-off signals and comprising converter means for converting the power-on and power-off signals to a second control signal having respectively a constant first voltage near ground and a constant second voltage displaced from ground, and a first transistor having a base terminal and power terminals and receiving the second control signal at its base terminal and entering first and second conduction states responsive respectively to the first and second voltages of the second control signal; and b) an interface circuit including a rectifier circuit having input terminals connected across the thyristor power terminals and an output terminal providing DC power when the thyristor is nonconductive, and a second transistor having a control terminal connected to the first transistor, said second transistor allowing current flow comprising the first and second states of the first control signal from the rectifier circuit output terminal to the thyristor control terminal responsive respectively to the first and second conduction states of the first transistor.

2. The power switching circuit of claim 1, wherein the detector means includes a first capacitor connected from the first transistor's base terminal to ground, a first impedance connected from the rectifier circuit's output terminal to the first transistor's base terminal, and a second capacitor carrying the signals from the microprocessor output port to the first capacitor; and wherein the interface circuit includes a second impedance connecting the second transistor's control terminal to the rectifier circuit's output terminal.

3. The power switching circuit of claim 2, wherein the interface means includes a third capacitor connected between the control terminal of the second transistor and ground, and the second transistor is of the type which conducts when the control terminal voltage is displaced by a predetermined amount toward the rectifier circuit's power terminal voltage.

4. The power switching circuit of claim 3, wherein the first and second impedances each comprise a resistor in series with a diode oriented to conduct current provided by the rectifier circuit's power terminal.

5. The power switching circuit of claim 4, wherein the series circuit of the first capacitor and the first impedance's resistor have a time constant substantially shorter than the time constant for the series circuit of the second capacitor and the second impedance's resistor.

6. The power switching circuit of claim 5, wherein the second transistor comprises a field effect transistor whose gate terminal comprises the control terminal.

7. The power switching circuit of claim 5, wherein the time constant for the series circuit of the first capacitor and the first impedance's resistor is approximately ten times shorter than the time constant for the series circuit of the third capacitor and the second impedance's resistor.

* * * * *